US009709238B2

(12) United States Patent
Dunn et al.

(10) Patent No.: US 9,709,238 B2
(45) Date of Patent: Jul. 18, 2017

(54) MODULAR HEADLAMP ASSEMBLY WITH A HEATING ELEMENT FOR REMOVING WATER BASED CONTAMINATION

(71) Applicants: Timothy Dunn, Falconer, NY (US); Timothy DiPenti, Russell, PA (US); Jeffrey L. Church, Gerry, NY (US); Michael Marley, Erie, PA (US); Nedim Hamzic, Falconer, NY (US); Barry C. Johnson, Lakewood, NY (US)

(72) Inventors: Timothy Dunn, Falconer, NY (US); Timothy DiPenti, Russell, PA (US); Jeffrey L. Church, Gerry, NY (US); Michael Marley, Erie, PA (US); Nedim Hamzic, Falconer, NY (US); Barry C. Johnson, Lakewood, NY (US)

(73) Assignee: Truck-Lite Co., LLC, Falconer, NY (US)

( * ) Notice: Subject to any disclaimer, the term of this patent is extended or adjusted under 35 U.S.C. 154(b) by 0 days.

(21) Appl. No.: 14/531,957

(22) Filed: Nov. 3, 2014

(65) Prior Publication Data

US 2016/0215952 A1 Jul. 28, 2016

Related U.S. Application Data

(63) Continuation-in-part of application No. 13/289,832, filed on Nov. 4, 2011, now Pat. No. 8,899,803, which (Continued)

(51) Int. Cl.
*F21S 8/10* (2006.01)
*F21Y 115/10* (2016.01)

(52) U.S. Cl.
CPC ..... *F21S 48/34* (2013.01); *F21S 48/115* (2013.01); *F21S 48/1154* (2013.01); *F21S 48/328* (2013.01); *F21Y 2115/10* (2016.08)

(58) Field of Classification Search
None
See application file for complete search history.

(56) References Cited

U.S. PATENT DOCUMENTS

2006/0011598 A1* 1/2006 Yasuda ..... F21S 48/25 219/205
2006/0050521 A1* 3/2006 Mochizuki ..... B60S 1/603 362/459

(Continued)

*Primary Examiner* — Britt D Hanley
(74) *Attorney, Agent, or Firm* — The Bilicki Law Firm, P.C.; Rebecca M.K. Tapscott

(57) ABSTRACT

A modular headlamp assembly includes a low beam headlamp module, a high beam headlamp module, and front turn/parking lamp module. The low beam headlamp module and the high beam headlamp module are supported by a reflector carrier. Each of the high and low beam headlamp modules includes a heat sink and mounting assembly with a heat sink portion bisecting a reflector member. The headlamp includes a lens with a wire heating element embedded therein and a wire heating element circuit board affixed to the lens. A thermistor is affixed to the lens for sensing when the lens reaches a predetermined condition and a microcontroller is provided for activating or deactivating the wire heating element based on the predetermined condition sensed by the thermistor.

16 Claims, 10 Drawing Sheets

Related U.S. Application Data is a continuation-in-part of application No. 13/024,323, filed on Feb. 9, 2011, now Pat. No. 8,459,848, application No. 14/531,957, which is a continuation-in-part of application No. 13/246,481, filed on Sep. 27, 2011, now Pat. No. 9,518,711.

(56) References Cited

U.S. PATENT DOCUMENTS

| | | | | |
|---|---|---|---|---|
| 2006/0232972 | A1* | 10/2006 | Mochizuki | F21V 29/90 362/253 |
| 2006/0278803 | A1* | 12/2006 | Mochizuki | B29C 45/14336 248/538 |
| 2007/0025105 | A1* | 2/2007 | Inoue | B60Q 1/0683 362/249.07 |
| 2007/0181565 | A1* | 8/2007 | Murahashi | B60Q 1/0005 219/629 |
| 2012/0201031 | A1* | 8/2012 | Marley | G02B 27/0006 362/294 |
| 2012/0201043 | A1* | 8/2012 | DiPenti | F21S 48/1104 362/545 |
| 2013/0114279 | A1* | 5/2013 | Marley | F21S 48/115 362/516 |

* cited by examiner

MODULAR HEADLAMP ASSEMBLY WITH A HEATING ELEMENT FOR REMOVING WATER BASED CONTAMINATION

BRIEF SUMMARY

A modular headlamp assembly includes a low beam headlamp module, a high beam headlamp module, and front turn/parking lamp module. The low beam headlamp module and the high beam headlamp module are supported by a reflector carrier. Each of the high and low beam headlamp modules includes a heat sink and mounting assembly with a heat sink portion bisecting a reflector member. The headlamp includes a lens with a wire heating element embedded therein and a wire heating element circuit board affixed to the lens. A thermistor is affixed to the lens for sensing when the lens reaches a predetermined condition and a microcontroller is provided for activating or deactivating the wire heating element based on the predetermined condition sensed by the thermistor.

DETAILED DESCRIPTION

Figure 1:
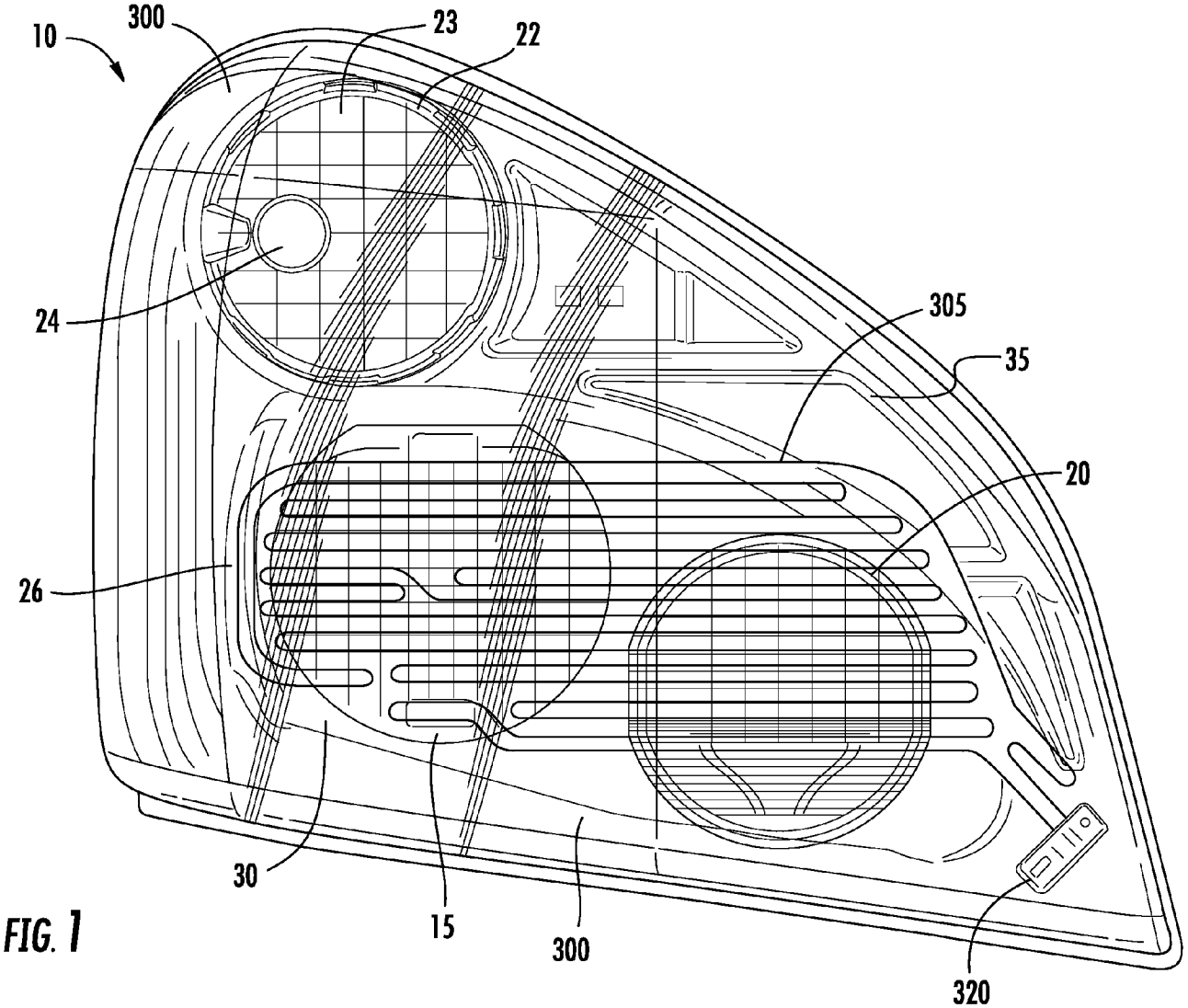
FIG. 1 is a front view of a modular headlamp assembly according to the present application.

As illustrated in FIG. 1, a modular headlamp assembly is generally indicated at 10. Modular headlamp assembly 10 includes a low beam headlamp module 15 and a high beam headlamp module 20. A front turn/parking lamp module 22 having a reflector 23 and a bulb 24 is also included. Low beam headlamp module 15 and high beam headlamp module

20 and a side reflex reflector 26 are supported by a reflector carrier 30, which is adjustably fastened to a housing 35. The modular headlamp assembly according to the present application also includes a lens 300 provided over housing 35 for light to pass through from low beam headlamp module 15, high beam headlamp module 20, and front turn/parking lamp module 22. Lens 300 includes heating elements 305 and a circuit board 320 for removing water based contamination in the form of snow and ice build-up, which will be described in detail below.

Figure 2:
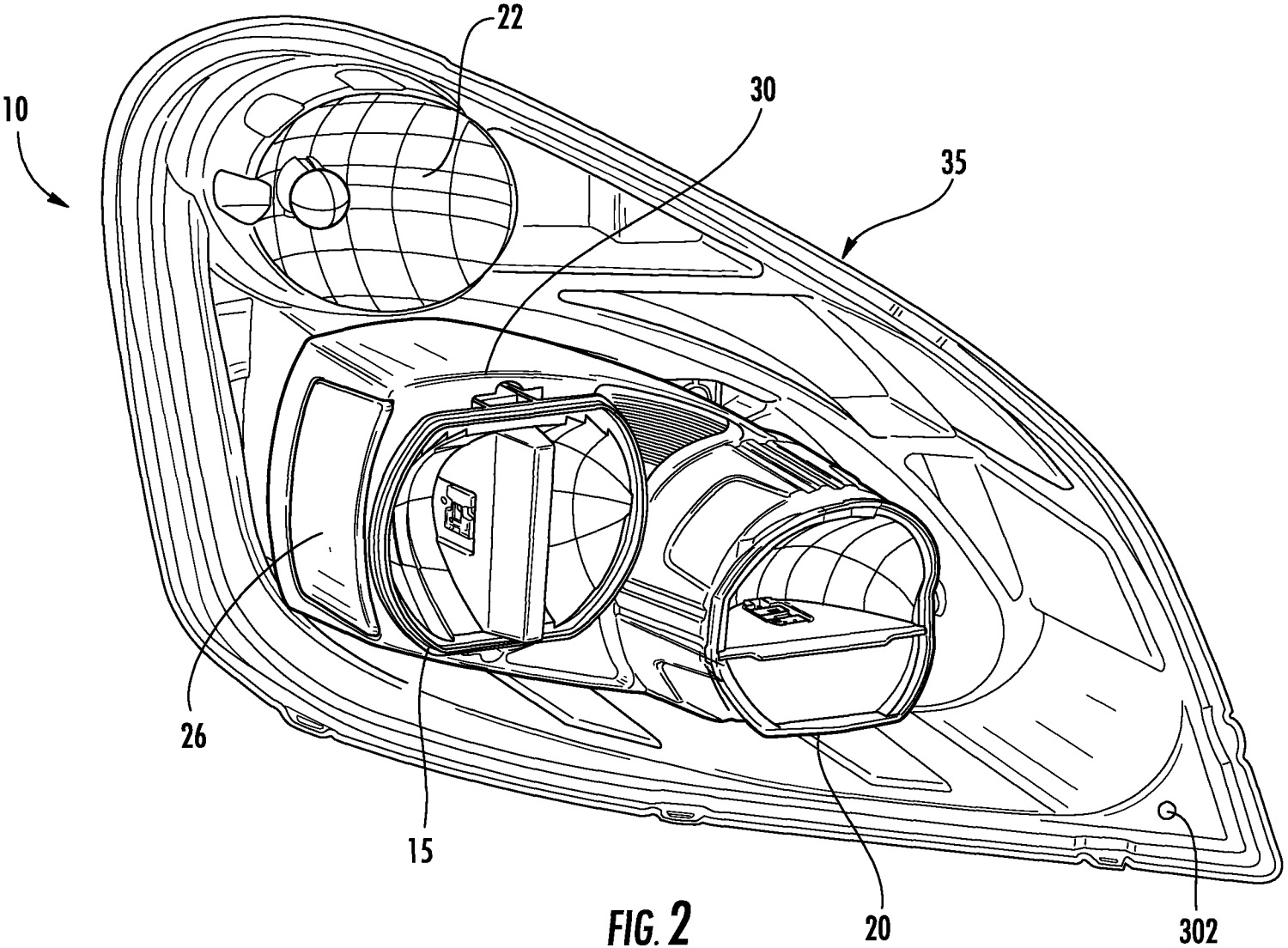
FIG. 2 is a front perspective view of the modular headlamp assembly of FIG. 1 with a lens removed.

FIG. 2 is a front view of headlamp assembly 10 with lens 300 removed. Reflector carrier 30 is shown supporting low beam headlamp module 15 and high beam headlamp module 20 and a side reflex reflector 26. Front turn/parking lamp module 22 and reflector carrier 30 are positioned within housing 35. An aperture 302 is formed within a bottom corner of housing 35 for providing a path for heating element wires, as will be discussed below.

Figure 3:
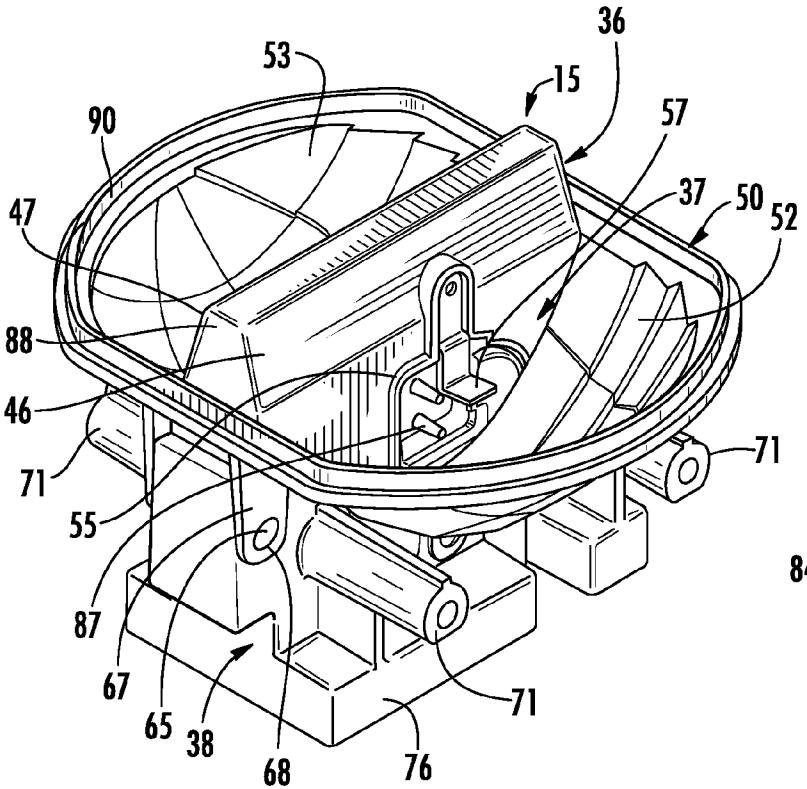
FIG. 3 is a perspective view of a low beam module of the modular headlamp assembly.

FIG. 3 is a perspective view of low beam headlamp module 15 of modular headlamp assembly 10 including a heat sink and mounting assembly 36, which has a low beam heat sink portion 37 and a low beam mounting portion 38. Heat sink and mounting assembly 36 is formed from a thermally conductive material such as die cast aluminum, copper or magnesium. In addition, the heat sink and mounting assembly 36 is treated with a black thermally emissive coating to facilitate heat transfer through radiation. The coating may be an E-coat, an anodized coating, or a powder coat. In the embodiment shown, low beam heat sink portion 37 is oriented and bisects low beam headlamp module vertically in order to aid in thermal transfer. However, in other embodiments low beam heat sink portion 37 may be oriented horizontally such that it bisects low beam headlamp module 15 horizontally.

In general, low beam headlamp module 15 includes at least one low beam LED light source 40, which may be a 1×2 or a 1×4 Altilon LED Assembly manufactured by Philips Lumileds. Low beam LED light source 40 is mounted to low beam heat sink portion 37, having first and second sides 46 and 47, that extends through a low beam reflector member 50 such that low beam heat sink portion 37 bisects reflector member 50 into first and second segments 52 and 53. In the embodiment shown low beam LED light source 40 is oriented such that the axis of the light emitting die on the light source is arranged substantially parallel with the axis of emitted light. Alternatively, the axis of the light emitting die on low beam LED light source 40 may be oriented substantially perpendicular to the axis of the emitted light. At least one of first and second sides 46 and 47 of low beam heat sink portion 37 includes a light source receiving portion 55 for containing low beam LED light source 40 and a light shield 57 positioned adjacent to low beam LED light source 40 for blocking a portion of the light in a low beam pattern. In particular, in the embodiment illustrated, light shield 57 blocks light from low beam LED light source 40 in the range of 10U-90U. With the illustrated light shield 57, the light intensity in the light pattern from 10 degrees UP to 90 degrees UP and 90 degrees LEFT to 90 degrees RIGHT will not exceed 125 candela. The shape and location of light shield 57 may vary according to the shape and design of modular headlamp assembly 10. There are several factors which dictate the location and shape of the part, such as orientation of the LED die, reflector shape, and position within reflector. A thermally conductive compound is disposed between low beam heat sink portion 37 and low beam LED light source 40. Low beam mounting portion 38 includes alignment features 65 formed on stepped portions 66 that extend from mounting structure for facilitating the alignment of low beam reflector member 50 with low beam mounting portion 38. In particular, low beam reflector member 50 includes tabs 67 with apertures 68 formed therein for mating with alignment features 65 of low beam mounting portion 38.

Figure 4:
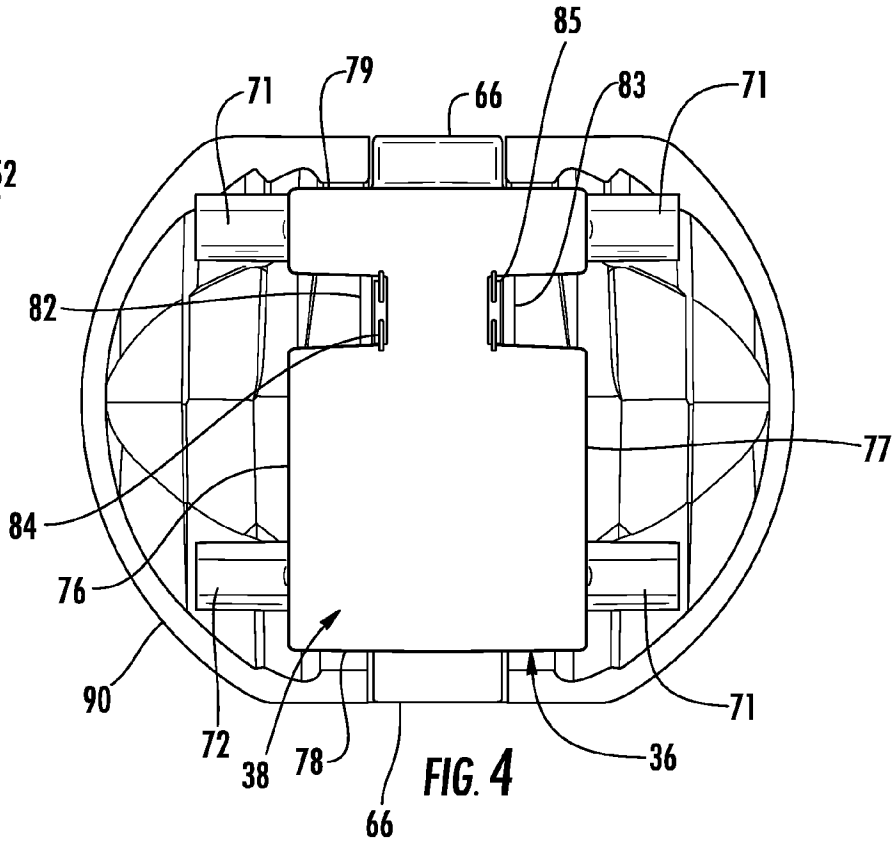
FIG. 4 is a bottom view of the low beam module of the modular headlamp assembly.

FIG. 4 illustrates bottom view of low beam module 15. Low beam mounting portion 38 includes a base portion 70 which may be adapted to receive a driver circuit assembly (not shown). A plurality of mounting extensions 71 protrude from side edges 76 and 77 of base portion 70 adjacent to edges 78 and 79. In addition, channels 82 and 83 are formed within base portion 70 along edges 76 and 77 to accommodate electrical leads 84 and 85 from low beam LED light source 40.

FIGS. 5-8 illustrate a perspective, bottom, top, and back views of high beam headlamp module 20. High beam headlamp module 20 includes a high beam heat sink and mounting assembly 100 having a high beam heat sink portion 102 and a high beam mounting portion 103. Heat sink and mounting assembly 100 is formed from a thermally conductive material such as die cast aluminum, copper or magnesium. In addition, the heat sink and mounting assembly 100 is treated with a black thermally emissive coating to facilitate heat transfer through radiation. The coating may be an E-coat, an anodized coating, or a powder coat. A high beam reflector member 104 mounted to high beam heat sink and mounting assembly 100 such that high beam heat sink portion 102 extends outward towards a bottom end of reflector member 104.

Reflector member 104 includes an upper reflective portion 105 and a lower portion 106, which are separated by high beam heat sink portion 102. Upper reflective portion 105 has a complex reflector optic design. The complex reflector optical design includes multiple intersecting segments. The segments intersect at points that may be profound and visible or blended to form a uniform single surface. Reflector member 104, in the embodiment shown, is a single component surrounding high beam heat sink portion 102. Alternatively, reflector member 104 may be composed of multiple separate and distinct reflector components individually mounted on either side of high beam heat sink portion 102. Reflector member 104 is formed of a thermoplastic or thermoset vacuum metalized material. For example, reflector member 104 may be formed of ULTEM, polycarbonate, or a bulk molding compound.

High beam heat sink portion 102 includes first and second sides 110 and 115. A high beam LED light source 120 is mounted to first side 110 of high beam heat sink portion 102 in a light source receiving portion 122 formed therein. Light source receiving portion 122 may take the form of an indented area sized to receive High beam LED light source 120. Alignment posts, 123, may be formed in light source receiving portion 122 for aligning with apertures 124 in High beam LED light source 120 to insure that High beam LED light source 120 is accurately located on heat sink portion 102. In addition, light source receiving portion 122 may include holes (not shown) formed therein for accepting fasteners, used for securing the LED light source to heat sink portion 102. A thermally conductive compound may be disposed between high beam heat sink portion 102 and High beam LED light source 120.

Figure 5:
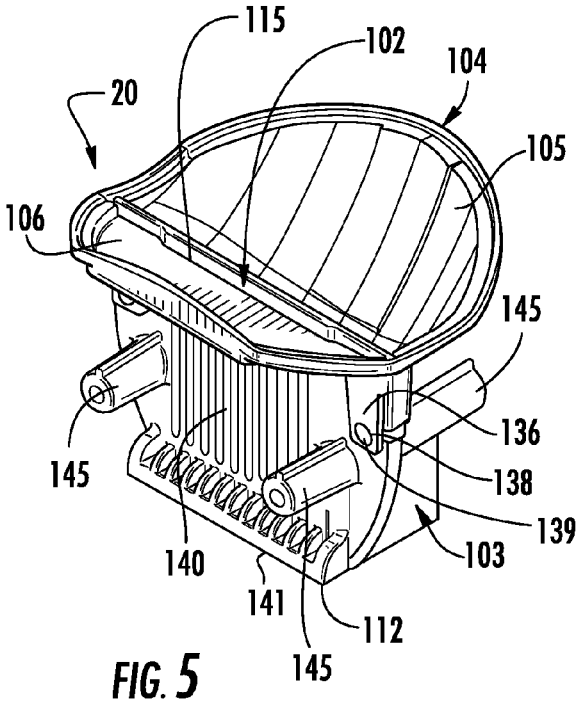
FIG. 5 is a perspective view of a high beam module of the modular headlamp assembly.
Figure 6:
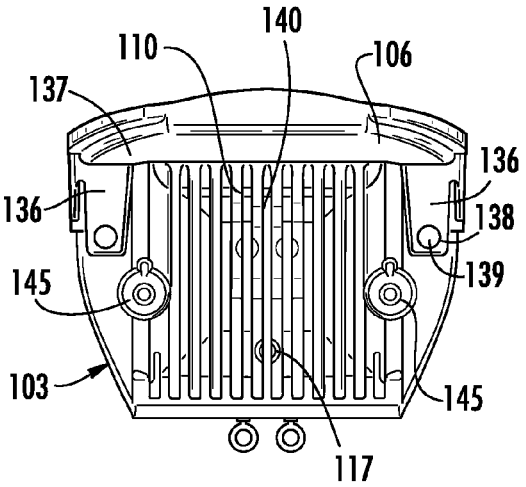
FIG. 6 is a bottom view of a high beam module of the modular headlamp assembly.
Figure 7:
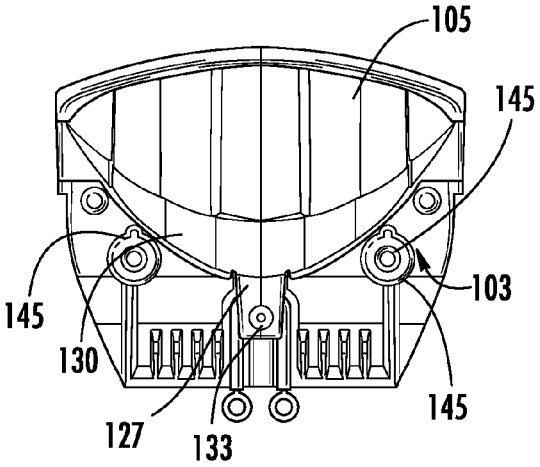
FIG. 7 is a top view of a high beam module of the modular headlamp assembly.
Figure 8:
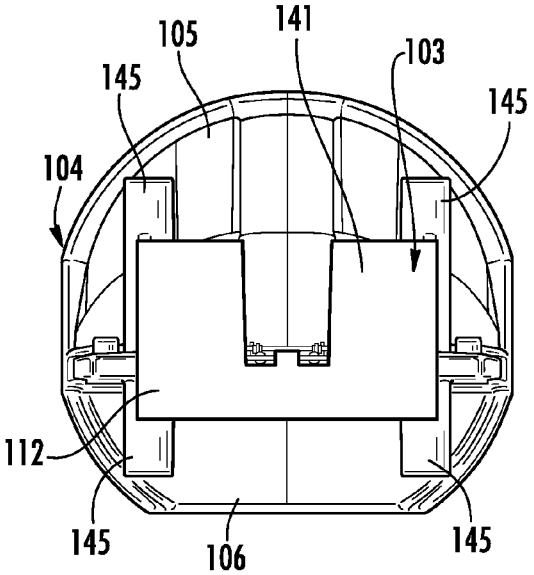
FIG. 8 is a bottom view of a high beam module of the modular headlamp assembly.

In the embodiment shown lower portion 106 is formed integrally with upper reflective portion 105 such that it extends below high beam heat sink portion 102, as shown in FIG. 7. In addition high beam reflector member 104 includes a tab 127 extending from a back end 130 of upper reflective portion 105. Tab 127 includes an aperture 133 formed therein for mating with an alignment feature 135 formed on high beam mounting portion 103 (see FIG. 7). Further, tabs 136 extend from a back end 137 of lower portion 106. Each of tabs 136 includes an aperture 138 formed therein for mating with alignment features 139 formed on high beam mounting portion 103, as shown in FIGS. 5 and 6. High beam mounting portion 103 includes fins 140 for heat dissipation which terminate at a base portion 141. A plurality of mounting extensions, one of which is indicated at 145, protrude from high beam mounting portion 103 for mounting high beam headlamp module 20 to reflector carrier 30. Additional details of the modular headlamp assembly are disclosed in U.S. patent application Ser. No. 13/246,481, which is incorporated herein by reference.

Figure 9:
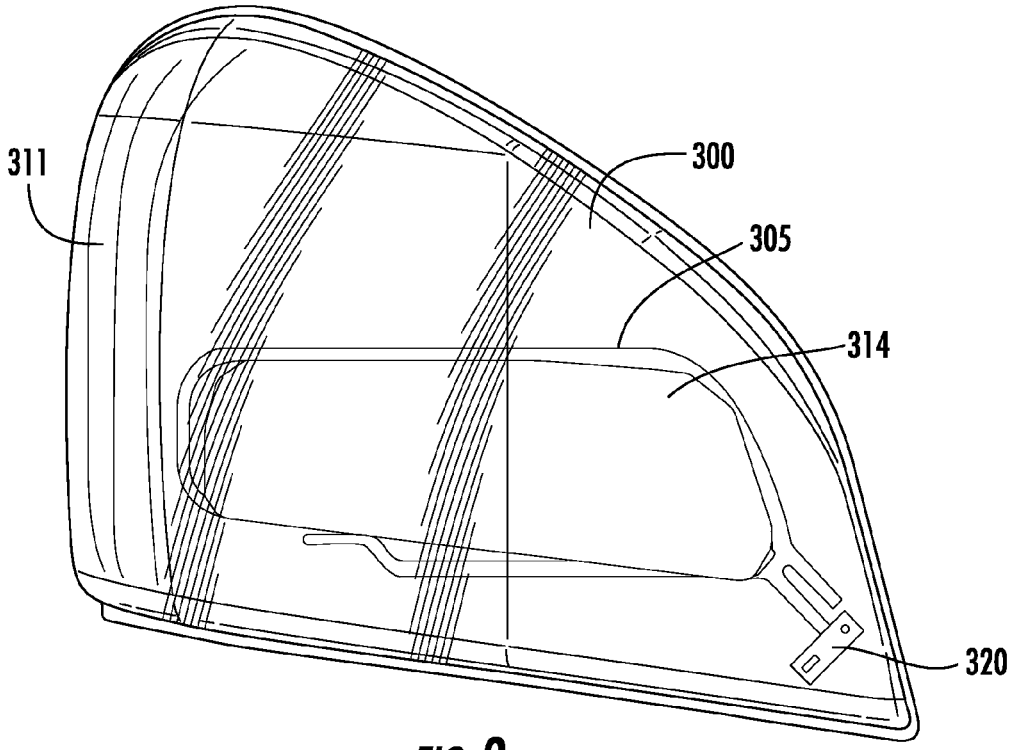
FIG. 9 is a front view of the lens of the modular headlamp assembly.
Figure 10:
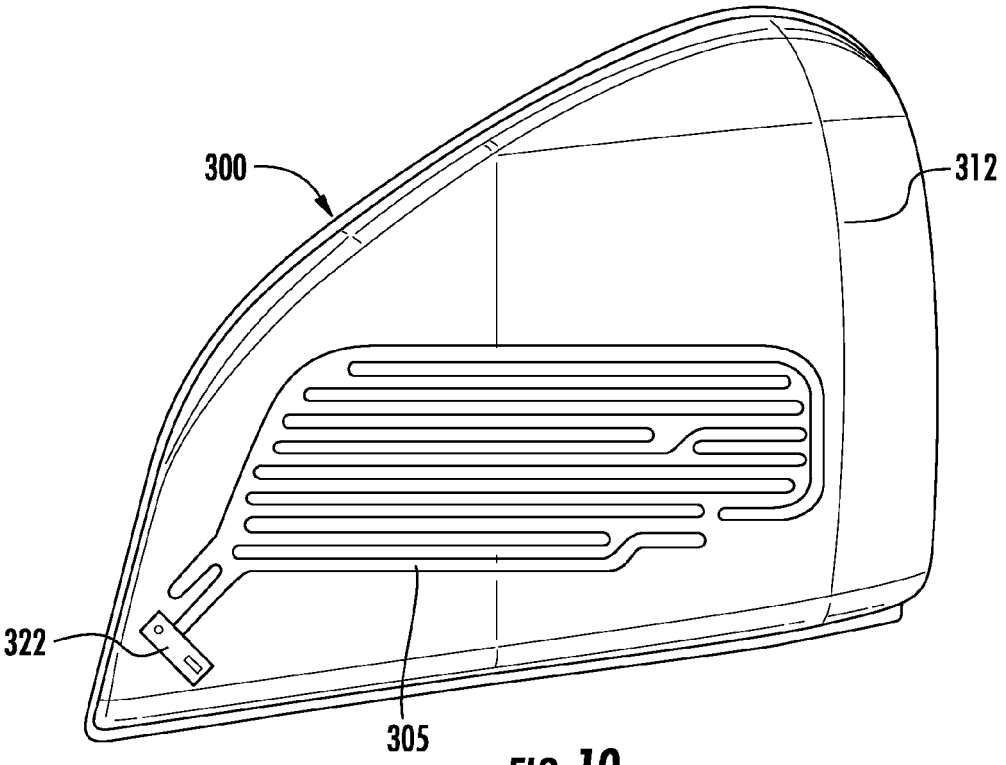
FIG. 10 is a back view of the lens of the modular headlamp assembly.

In accordance with embodiments of the invention, with reference to FIG. 9, lens 300 includes an exterior surface 311 and an optical area 314, which covers high and low beam modules 15 and 20. Heating element 305 is positioned behind optical area 314 and is connected to a heating element circuit board 320. Lens 300 is typically an optical grade exterior lens which is exposed to the outside environment. FIG. 10 illustrates a back view of lens 300, with interior surface 312, wherein resistive wire heating element 305 is embedded into interior surface 312 of lens material using ultrasonic technology. The embedding via ultrasonic technology may be performed through robotics to easily accommodate variations in lens surface, variables in wire patterns, and for improved accuracy and speed. Wire heating element 305 may also be attached to non-embeddable materials using ultrasonic technology with the use of coated wire wherein the coating material is melted ultrasonically, thereby becoming an adhesive between wire heating element 305 and the non-embeddable material.

Resistive wire heating element 305 may include a copper core with a silver coating to prevent corrosion of wire heating element 305. Typically resistive wire heating element 305 is embedded in lens 300 at a depth approximately ⅔ of the full wire diameter (⅔d). In one embodiment, the diameter of resistive wire heating element 305 is approximately 3.5/1000 inches so the embedding depth is between 0.0023 to 0.0035 inches. The wire is embedded by tapping it into the lens at a frequency which locally excites the lens molecules causing the lens to melt locally to the wire.

In particular, wire 305 is embedded using a sonic energy source to excite the plastic hydro-carbon polymer of lens 300 into a thermal state condition, softening the hydrocarbon polymer surface, which allows wire 305 to be embedded into a portion of the lens surface that is in contact with the wire at the time of the embedment process. The wire embedment process utilizes thermal transfer, coupled with a force control device that provides constant pressure and velocity to the wire such that a wire is consistently applied on the optical surface. The embedded wire can be applied to any complex and contoured surface using the force control device and the sonic energy in an isolated pattern to heat the wire embedded. Force control is used to prevent pushing the wire down farther than desired (so that the embedding head does not directly impact the lens). The embedded wire is then terminated to a printed circuit board by soldering, thermal compression bonding, etc. The wire may be embedded in the area of the lens which contributes to the photometric pattern of the low beam and high beam light sources, but could include the entire inner surface of the exterior lens, low beam only, etc.

An encapsulating material may be used to cover wire heating element 305 on interior surface 312 of lens 300 to prevent localized superheating (i.e. fusing) of wire heating element 305 due to exposure to air. If wire heating element 305 is exposed directly to the air the heat generated in wire heating element 305 cannot transfer fast enough to the air through convection. Thus, the temperature of wire heating element 305 exceeds the melt temperature of wire heating element 305. The encapsulating material prevents overheating by accepting heat transfer through conduction on the order of 1000 times faster than convection to the air. Thus, the temperature of wire heating element 305 is not raised enough to melt the wire, the lens, or the encapsulating material(s). In particular, the inside surface of the embedded lens is coated with a Hexamethyldisiloxane compound to totally surround the copper wire that is embedded into the lens. The coating is optically clear to reduce photometric degradation. Other encapsulating materials that are Department of Transportation compliant, as specified for optical grade materials/coatings, must have adequate adhesion to the lens material, must have temperature limitations not less than that of the lens material or the heater wire maximum temperature under prescribed conditions, and must not violate other design features/parameters. The encapsulating material also helps to prevent wire heating element 305 from coming free from lens 300 due to random vibration or impact.

A coating or encapsulating material may also be applied on an outer surface 311 of lens 300 to protect lens 300 against deterioration from weather (UV rays, heat, cold, rain, snow, and ice). It also resists damage from sand and dirt. It is specifically required on polycarbonate headlamp lenses to meet FMVSS 108 abrasion test requirements and chemical resistance (ASTM Fuel Reference C, Tar Remover, Power Steering Fluid, Antifreeze, and windshield washer fluid). The coating material may or may not be UV or thermally cured. Some alternative coating materials are Momentive PHC 587, Momentive AS 4700, and Red Spot 620V.

Figure 11:
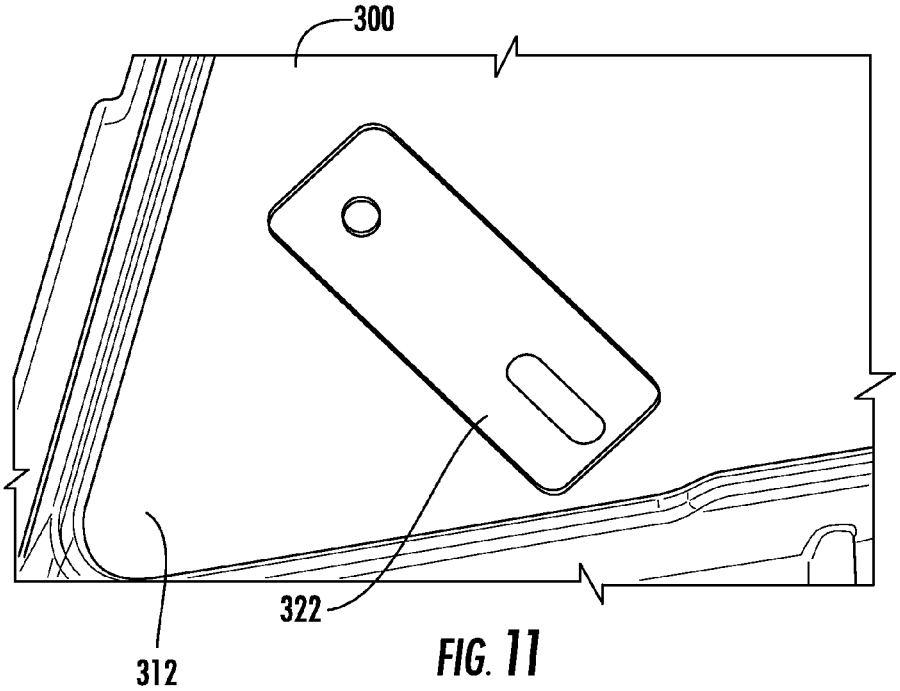
FIG. 11 is a detail view of a lens heating element circuit board of the modular headlamp assembly.

Wire heating element 305 is actively controlled in order to increase performance and efficiency of the wire heating element 305. A heating element circuit board 320 is attached to the headlamp circuit board, as discussed in detail below. As shown in FIGS. 10 and 11, a recess 322 is provided in lens 300, as shown formed in inner surface 312 of lens 300, to accept heating element circuit board 320. In the embodiments shown, heating element recess 322 and circuit board 320 are positioned in the inboard corner of lens 300 so as to not obstruct the photometric pattern of the low beam or high beam functions, to improve aesthetic appearance, and to provide a convenient location for attachment to a mating harness for electrical connection to a main driver circuit board. However, circuit board 320 could be positioned in other locations of lens 300. Thermal compression bonding or welding is utilized to attach heating element circuit board 320 to lens 300. For example, heating element circuit board 320 may be affixed to lens 300 using a two component, 1:1 mix ratio epoxy from Star Technology (Versabond ER1006LV). Alternate adhesives may be used based on temperature range, adhesive strength/durability, out-gassing properties, chemical reactivity, flexibility, application method, cure time, appearance, availability, and cost. Acceptable adhesives include non-cyanoacrylate based adhesives.

Figure 12:
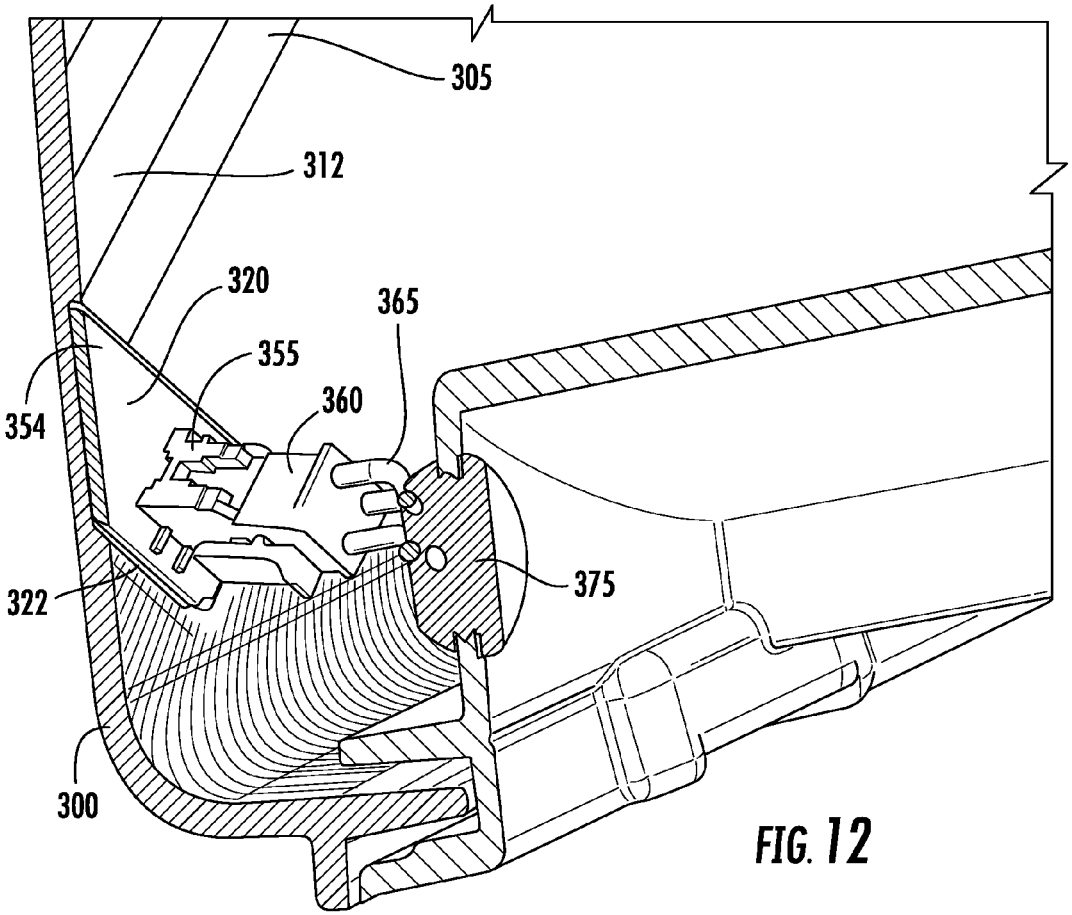
FIG. 12 is a back perspective view of the heating element circuit board and lens of the modular headlamp assembly.
Figure 13A:
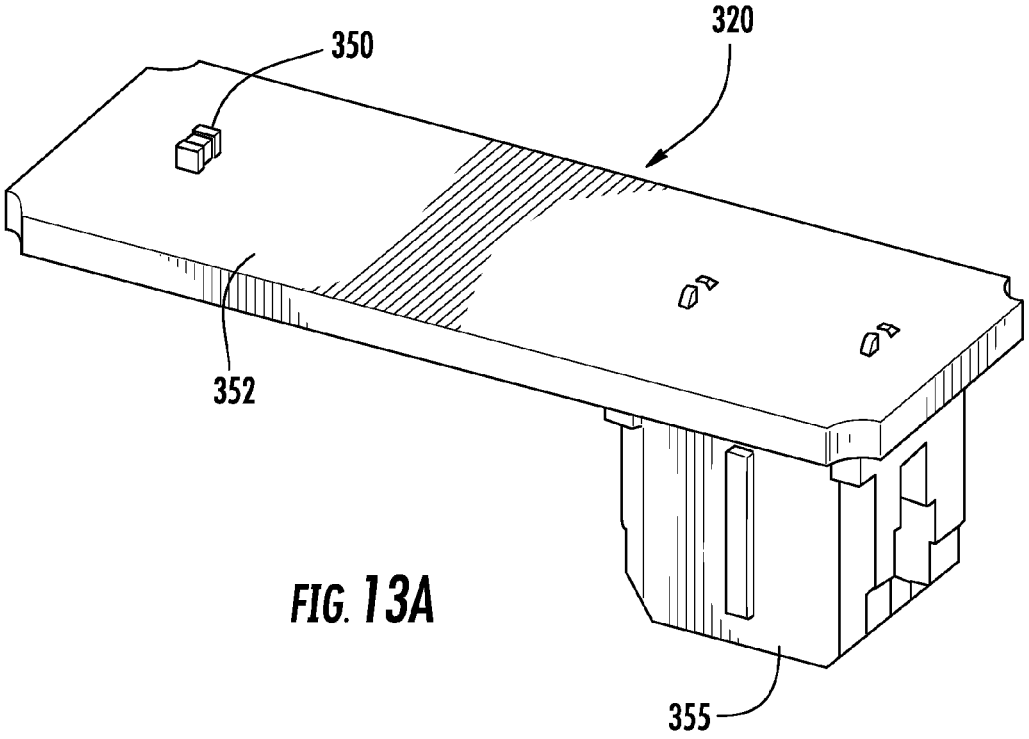
FIG. 13A is a top view of the heating element circuit board.
Figure 13B:
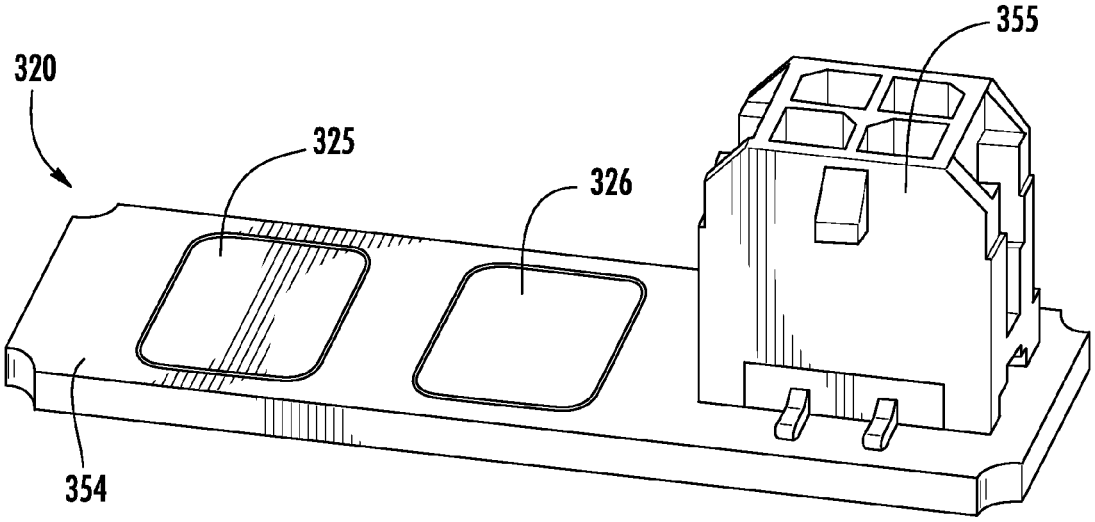
FIG. 13B is a back view of the heating element circuit board.

FIG. 12 illustrates heating element circuit board 320 affixed to inner surface 312 of lens 300 at recess 322. As illustrated, heating element 305 contacts heating element circuit board 320. FIGS. 13A and 13B illustrate first and second sides of heating element circuit board 320. In general, heating element circuit board 320 includes a thermistor 350 on the outward facing or first side 352 for heater control feedback purposes. Heating element circuit board 320 also includes two conducting pad areas 325 and 326 on an inner or second side 354 to which wire heating element 305 is soldered. Heating element circuit board 320 and thermistor 350 are placed into lens 300 such that the distance between an outer surface thermistor 350 and an outer surface of the lens does not exceed 1/10 the distance from the outer surface of thermistor and an inner surface of the lens at any one point for the purpose of minimizing the thermal impedance between thermistor 350 and outer lens surface and maximizing the thermal impedance between the thermistor and the inner lens surface. Thermal impedance is therefore manipulated by varying the thermistor's distance from the inner and outer surfaces of the lens, represented by the equation: $Do \leq (1/10)Di$ where Do=the distance from the thermistor to the outer lens and Di=the distance between the thermistor and inner lens. Therefore, the resistance to heat transfer is at least 10 times more from the thermistor to the inside air compared to the resistance to heat transfer between the thermistor and the outside of the lens.

The resistance of thermistor 350 may be used to accurately predict lens surface temperature wherein the ratio of distances versus the desired accuracy of the control system feedback is calculated and validated empirically. Thermal impedance is the resistance to transfer heat from any one point to any other point (if the thermal impedance is high, less heat transfer will occur and vice versa). Thermistor 350 is sensitive to temperature changes on the lens surface since that is the surface from which water-based contamination such as snow and ice is removed. Therefore, it is necessary to have a very low thermal impedance from thermistor 350 to lens outer surface 311. In this case, the lens material and outer lens coating are the thermal barriers between the thermistor and the outer lens. In addition, it is important to maximize the resistance from the thermistor to the inside of the lamp so the inside lamp temperature does not affect the temperature reading sensed by the thermistor.

The thermistor is essentially a surface mount resistor having approximate dimension: 0.03×0.065×0.03 inches (width, length, height) that is comprised mainly of alumina. The thermistor operates under a programmable logic sequence in order for the heating wire to be activated/deactivated automatically in order to melt snow and ice on the lens. The thermistor is used to provide feedback to the micro-controller in the form of a resistance. This resistance is correlated to a temperature that the micro-controller stores and uses to decide whether the heater should be on or off and at what level of power. The resistance/conductivity of wire heating element 305, as well as that of the actual thermistor 350 and heating element circuit board 320, is factored-in to optimize the operation of the thermistor. In one embodiment, wire heating element 305 is adapted to activate at 10 degrees C. and deactivate at 15 degrees C. However, the micro-controller may also be programmed to activate or deactivate wire heating element 305 based on a resistance that is stored in the microcontroller from current and voltage that is associated with a specific temperature. The thermistor manufacturer provides the data to make the correlation between the resistance and temperature.

In particular, the heater control is a closed loop controller comprised of a programmable micro controller (already existing in headlamp main PCB), the lens thermistor, a current sensing resistor, a voltage sensor, a mosfet, and the heater wire circuit. The micro-controller monitors the outer lens temperature by calculating the lens thermistor's resistance at regular clock intervals, which has a known correlation to temperature. When the temperature is determined to be at or below a set activation temperature (programmed into the micro-controller), the micro-controller provides a signal to the mosfet which connects one leg of the heater circuit to lamp power (the other leg is connected to ground), therein powering the heater. If the temperature is determined to be above a set deactivation temperature (also programmed into the micro-controller), it provides a signal to the mosfet to disconnect the leg of the heater circuit from power, therein removing any power in the heater circuit. The micro-controller can also modulate power for the purpose of power regulation. Further, the microcontroller calculates heater wire temperature and will regulate heater power to prevent the heater wire from exceeding the melt or softening temperature of the lens material as needed.

Heating element circuit board 320 contains conductive pads 325, 236 to facilitate heater circuit leads in consideration of the circuit configuration plus two thermistor control leads. The conductive pads may be formed of copper covered nickel coated with gold to provide a non-corroding, malleable surface that is conducive to welding or thermal compression bonding of wire heating element 305, as well as additional electrical attachment via spring containing (pogo) pins. In general, thermal compression bonding includes applying high temperature and pressure (locally) to mechanically fuse two materials together. Typically, a hard material is superimposed onto the end of a pressing mechanism capable of high pressure with a heating element used to heat the hard material. The two materials desired to be bonded together are pressed together with substantial force while the hard material on the end of the press is heated causing the two materials to bond together at the molecular level. The process can be used to bond similar materials (metal to metal) or dissimilar materials (metal to ceramic) together effectively.

Figure 15:
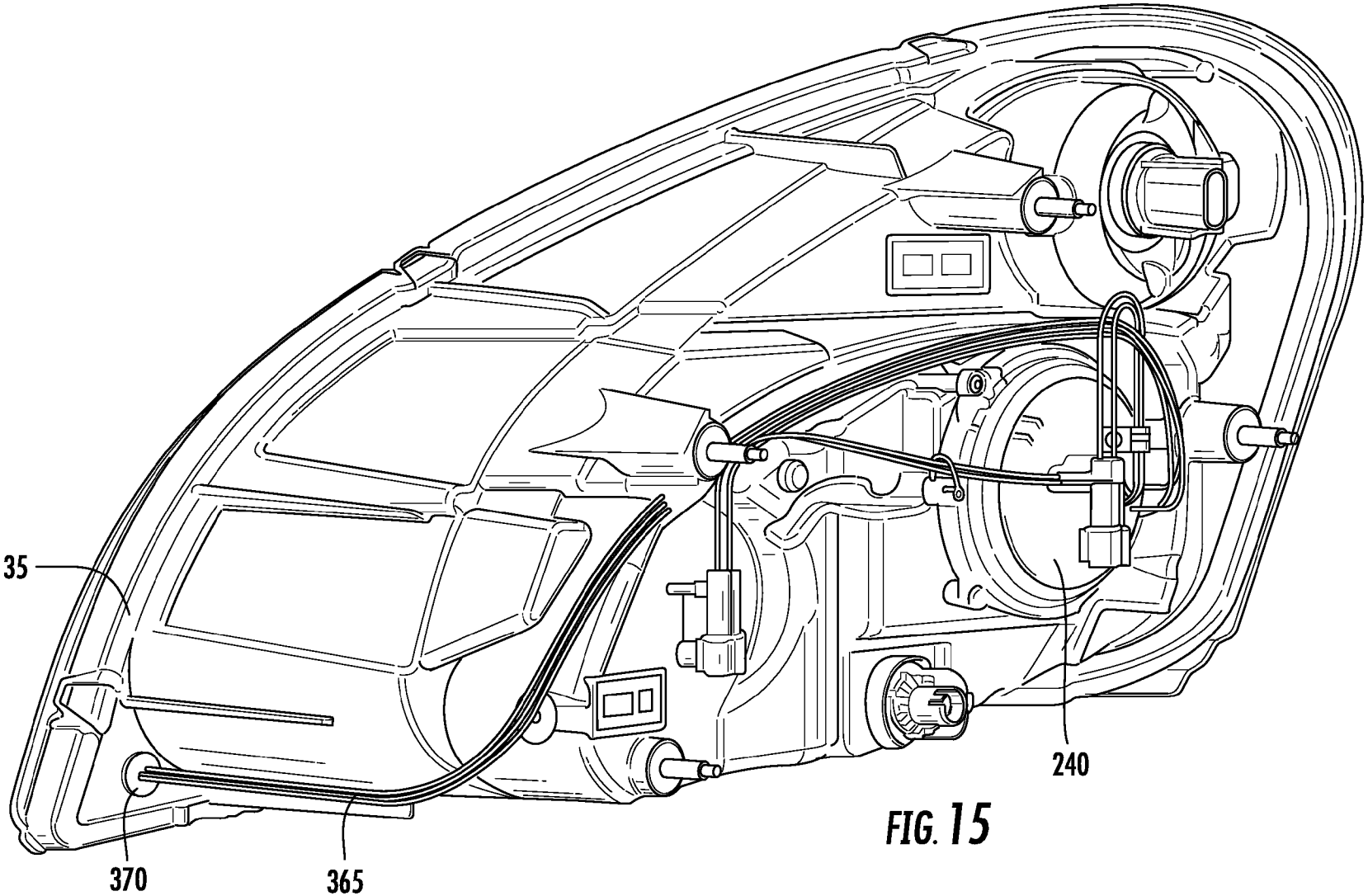
FIG. 15 is a back perspective view of the modular headlamp assembly.

Heating element circuit board 320 also includes a circuit board connector 355 for engaging a mating connector 360, as shown in FIG. 12, for connecting heating element circuit board 320 and thermistor 350 to the lamp main driver board. In particular, as shown in FIG. 15, electrical connection between heating element circuit board 320 and main driver board is achieved through pigtail wires 365 which exit driver board heat sink module 240 and are routed along a back of housing 35 and through aperture 302 in housing 35 behind heating element circuit board 320. A wire seal 370 is used to route wires 365 through hole while maintaining an environmental seal. Individual wire seals are also formed around each wire.

Figure 14A:
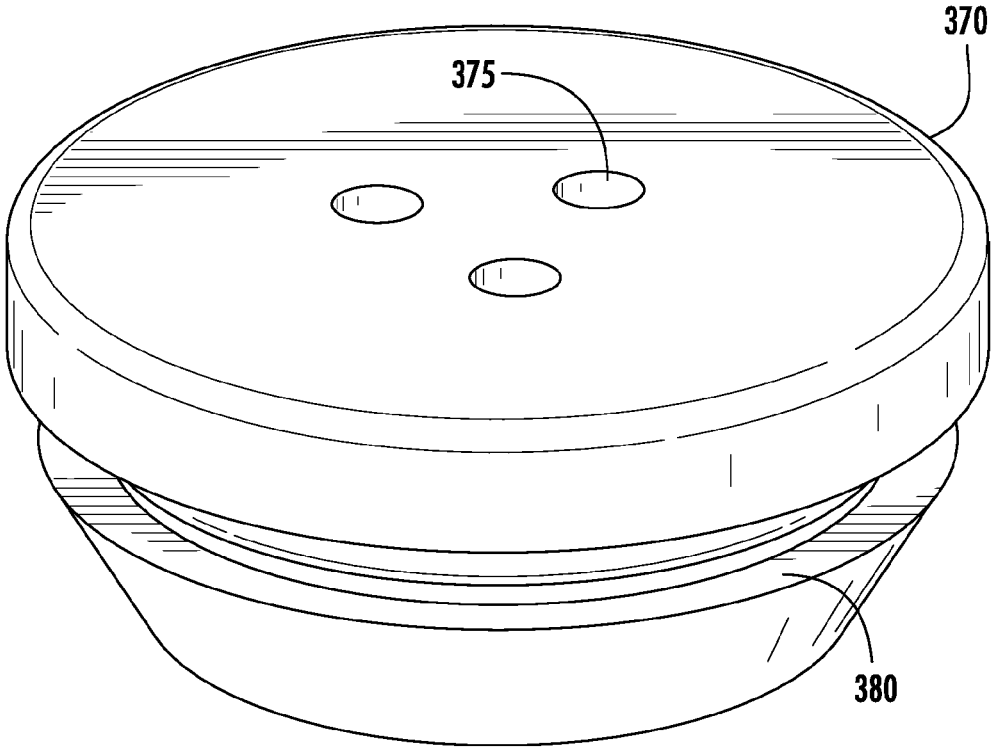
FIG. 14A is a perspective view of a seal for the modular headlamp assembly.
Figure 14B:
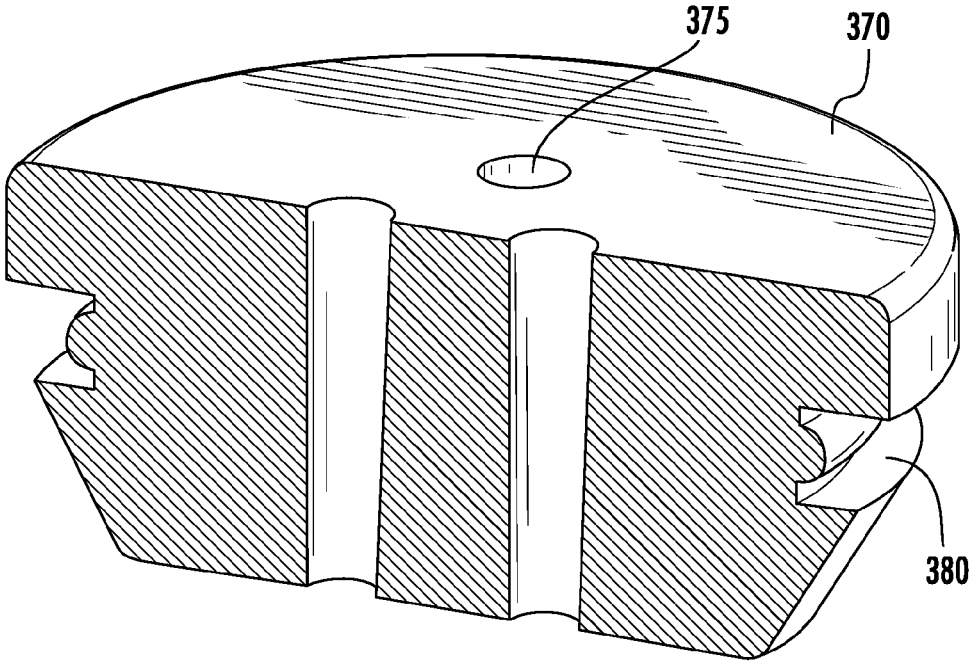
FIG. 14B is a cross-sectional view of the seal of FIG. 14A.

As illustrated in FIGS. 14A and 14B, wire seal 370 includes three holes 375 through which wires 365 pass. Wire seal 370 also includes a circumferential groove 380 for tightly engaging aperture 302 in housing 35. Wire seal is formed of an elastomeric material and is suitable for acting as a moisture barrier.

Figure 16:
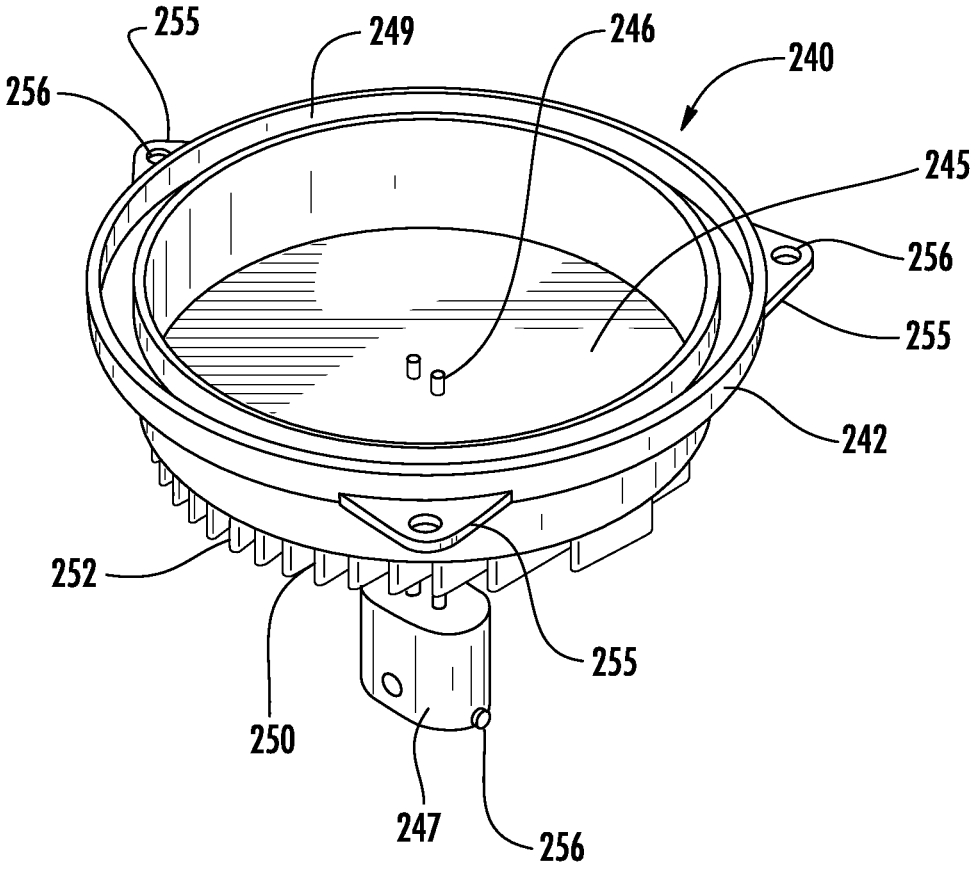
FIG. 16 is a perspective view of a drive circuit housing of the modular headlamp assembly.

FIG. 15 is a back perspective view of housing 35. In general, housing 35 includes a drive circuit module 240, shown in detail in FIG. 16, with an interior portion 245 adapted to contain a circuit board, such as a FR4 circuit board. Electrical leads 246 and connector 247 are adapted to connect the circuit board to a power source. Interior portion 245 is surrounded by a rim track 249 having a gasket positioned therein (not shown). Drive circuit housing 242 is formed of a thermally conductive material and acts as a heat sink. In addition, drive circuit housing 242 includes a back portion 250 having fins 252 formed therein for heat dissipation. Attachment tabs 255 with apertures 256 extend from drive circuit housing 242 for attaching drive circuit module 240 to headlamp housing 35. Drive circuit module 240 is mounted to headlamp housing 35 at a circuit board module receiving opening. As shown, wires 365 connect drive circuit module 240 and drive circuit board (not shown) to heating element circuit board 320.

Heating of lens 300 by wire 305 is activated based on lens temperature. Initially, the temperature of the lens is measured by thermistor 350. A decision is then made by logic in a microcontroller, processer, FPGA, other integrated circuit, or by analog circuitry whether to activate heating wire 305. A power converter, such as a SEPIC topology switch mode power supply, may be used to boost or step down power source voltage to match heater wire resistance. If such a power converter is used, a microcontroller will is used to decide what temperature to engage the heating wire and how much to engage the heating wire. If a power converter is not used, heater wire resistance is matched to power source voltage. Heating wire is then activated to heat lens 300.

Several factors are considered when determining when and how much heat is required to remove water based condensation from a lens. The area of the lens to be heated is first determined by considering the area(s) of the lens that light passes through for the lamp function(s) that will be active (or desired) when lens heating is necessary. From this data, the required heater power is determined using ambient temperature set to the lowest defined operating temperature of the lamp, an assumed water based contamination layer on the lens exterior (approximately 2 mm thick), lens material and thickness, and required wire spacing (assuming uniform and non-segmented heating is desired). Other considerations include lamp internal air temperature prediction based on the previously listed parameters and heat dissipation from active lamp functions (CFD used for this), time desired/required to remove the water based contamination, assumed air convection coefficient inside and outside of the lamp, latent heat of fusion of ice, density of ice, and heat capacity of all material in the heat transfer paths (including the ice). This information is used to mathematically express heat transfer from the wire to the air (both inside and outside of the lamp) and the amount of energy to raise the temperature of the ice to zero degrees C. and convert the ice to water as a function of time. The mathematical expressions are combined and solved to determine the amount of power required from the heater wire to melt the ice in the desired/required time period so that once the ice is melted, the water runs off the lens due to gravity.

When multiple operating voltages are required, multiple heating element circuits are used and configured in series, parallel, or a combination of series and parallel in order to attain uniform heater power at any of the prescribed input voltages for a linear type heater driver. Alternately, a switcher type driver may be used with a single heater circuit. The inherent resistance of the control system components including the thermistor in the lens must be offset in one of the heating element circuits for systems with multiple heating element circuits to ensure uniform heating between circuits (unless otherwise desired), because that resistance adds to the heating element circuit, therein reducing the amount of current that flows through it compared to other circuits. This is readily achieved by modifying the length of each circuit such that the resistances balance when the control system net resistance is added to one circuit. Straight paths of the heater circuit as embedded into the lens are minimized to reduce the appearance of light infringement within the optical pattern in order to produce a clearer more vivid shape that is more easily perceived by the human eye.

Additionally, the embedding process creates a meniscus of lens material along the heater wire. The shape of this meniscus bends light around the wire such that, for a curved path, light bent away from the wire which leaves a void at angle A, will be bent toward a void at angle B, thus reducing the clarity or even eliminating such void.

It will be understood by those skilled in the art that the above disclosure is not limited to the embodiments discussed herein and that other methods of controlling heating element, thermal transfer fluid circulating device, or Peltier heat pump may be utilized. These methods may include manual activation and deactivation of heating element, thermal transfer fluid circulating device, or Peltier device via an on/off switch. Other alternative embodiments include continuous activation of the elements so that LED lamp temperature is high enough to prevent accumulation of water-based contamination but low enough to prevent inadvertent thermal deterioration of the LED lamp and its components.

While description has been made in connection with embodiments and examples of the present invention, those skilled in the art will understand that various changes and modification may be made therein without departing from the present invention. It is aimed, therefore to cover in the appended claims all such changes and modifications falling within the true spirit and scope of the present invention.

We claim:

1. A modular headlamp assembly having a heating element for removing water based condensation, said headlamp comprising:

a low beam headlamp module including at least one low beam light emitting diode;

a high beam headlamp module including at least one high beam light emitting diode:

a reflector carrier for receiving said low beam headlamp module and said high beam headlamp module;

a housing including an interior portion for receiving said reflector carrier;

a drive circuit board coupled to said low and high beam light emitting diodes;

a lens affixed to the housing having an inner surface and an outer surface;

a wire heating element circuit board;

a wire heating element embedded within the inner surface of the lens, and electrically coupled to the wire heating element circuit board;

a thermistor affixed to the lens for sensing when the lens reaches a predetermined condition, said thermistor being electrically coupled to said wire heating element circuit board;

a connector for electrically connecting said heating wire element circuit board to said drive circuit board; and a micro-controller for activating or deactivating the wire heating element based on the predetermined condition sensed by the thermistor;

wherein said wire heating element, wire heating element circuit board, and thermistor are embedded in said lens.

2. The headlamp of claim 1, wherein said wire heating element is embedded in said lens at a depth of $2.3\times10^{-3}$ and $3.5\times10^{-3}$ inches.

3. The headlamp of claim 1, wherein a distance from an outer surface of said thermistor to the outer surface of said lens is no more than one tenth of a distance between said outer surface of the thermistor and the inner surface of said lens, represented by an equation: $Do\leq(1/10)Di$, where Do=the distance from the thermistor to the outer surface of the lens and Di=the distance between the thermistor and inner surface of the lens.

4. The headlamp of claim 1 further comprising an encapsulation layer disposed over the wire heating element.

5. The headlamp of claim 1 wherein the wire heating is affixed to said lens.

6. The headlamp assembly of claim 5, wherein said lens includes a recess for receiving said wire heating element circuit board.

7. A modular headlamp assembly having a heating element for removing water based condensation, said headlamp comprising:

a low beam headlamp module including:

a low beam heat sink and mounting assembly having a low beam heat sink portion with first and second sides and a low beam mounting portion having alignment features formed therein;

at least one low beam light emitting diode having an optical axis perpendicular to at least one of said first and second sides of the low beam heat sink portion; and a low beam reflector member attached to the low beam heat sink and mounting assembly such that the low beam heat sink portion separates the low beam reflector member into first and second segments;

a high beam headlamp module including:

at least one high beam light emitting diode;

a high beam heat sink and mounting assembly including a high beam heat sink portion having first and second sides, said at least one high beam light emitting diode having an optical axis perpendicular to the first side of the high beam heat sink portion and a high beam mounting portion, and a high beam mounting portion having alignment features formed therein;

a high beam reflector member including an upper reflective portion and a lower portion, which are separated by the high beam heat sink portion; and a reflector carrier including:

a first receiving pocket for the low beam headlamp module;

a second receiving pocket for the high beam headlamp module; and a housing including an interior portion having a reflector carrier receiving portion defined therein;

a drive circuit board coupled to said low and high beam light emitting diodes;

a lens affixed to the housing having an inner surface and an outer surface;

a wire heating element circuit board electrically connected to said drive circuit board, wherein said lens includes a recess for receiving said wire heating element circuit board;

a wire heating element embedded within the inner surface of the lens, and electrically coupled to the wire heating element circuit board;

a thermistor affixed to the lens for sensing when the lens reaches a predetermined condition, said thermistor being electrically coupled to said wire heating element circuit board; and a micro-controller for activating or deactivating the wire heating element based on the predetermined condition sensed by the thermistor.

8. The headlamp assembly of claim 7, wherein the wire heating element comprises a copper core and a silver coating.

9. The headlamp assembly of claim 7, wherein said wire heating element is embedded in said lens at a depth of $2.3\times10^{-3}$ to $3.5\times10^{-3}$ inches.

10. The headlamp assembly of claim 7, wherein said wire heating element, wire heating element circuit board, and thermistor are embedded in said lens.

11. The headlamp assembly of claim 7, wherein a distance from an outer surface of said thermistor to the outer surface of said lens is no more than one tenth of a distance between said outer surface of the thermistor and the inner surface of said lens, represented by an equation: $Do\leq(1/10)Di$, where Do=the distance from the thermistor to the outer surface of the lens and Di=the distance between the thermistor and inner surface of the lens.

12. The headlamp assembly of claim 7, wherein a connector connects said wire heating element circuit board and thermistor to said drive circuit board.

13. The headlamp assembly of claim 7 further including an encapsulation layer disposed over of the wire heating element.

14. A modular headlamp assembly having a heating element for removing water based condensation, said headlamp comprising:

a low beam headlamp module including at least one low beam light emitting diode;

a high beam headlamp module including at least one high beam light emitting diode:

a reflector carrier for receiving said low beam headlamp module and said high beam headlamp module;

a housing including an interior portion for receiving said reflector carrier;

a drive circuit board coupled to said low and high beam light emitting diodes;

a lens affixed to the housing having an inner surface and an outer surface;

a wire heating element circuit board, wherein said wire heating element circuit board is electrically connected to said drive circuit board and wherein said lens includes a recess for receiving said wire heating element circuit board;

a wire heating element embedded within the inner surface of the lens, and electrically coupled to the wire heating element circuit board;

a thermistor affixed to the lens for sensing when the lens reaches a predetermined condition, said thermistor being electrically coupled to said wire heating element circuit board;

a connector for electrically connecting said heating wire element circuit board to said drive circuit board; and a micro-controller for activating or deactivating the wire heating element based on the predetermined condition sensed by the thermistor.

15. The headlamp assembly of claim 14, wherein said wire heating element, wire heating element circuit board, and thermistor are embedded in said lens.

16. The headlamp assembly of claim 14, wherein a distance from an outer surface of said thermistor to the outer surface of said lens is no more than one tenth of a distance between said outer surface of the thermistor and the inner surface of said lens, represented by an equation: $Do\leq(1/10)Di$, where Do=the distance from the thermistor to the outer surface of the lens and Di=the distance between the thermistor and inner surface of the lens.

* * * * *